United States Patent [19]

Ostrowski et al.

[11] 4,070,812

[45] Jan. 31, 1978

[54] EQUIPMENT FOR PNEUMATIC MANUFACTURE OF YARN

[75] Inventors: Jerzy Ostrowski; Piotr Sierputowski, both of Warsaw; Lukasz Turkowski, Sulejowek-Ratajewo; Jerzy Jablkiewicz; Jan Pacholski, both of Lodz; Tadeusz Jedryka, Warsaw, all of Poland

[73] Assignee: Centralny Osrodek Badawczo-Rozwojowy Naszyn Wlokienniczych, Lodz, Poland

[21] Appl. No.: 773,123

[22] Filed: Feb. 28, 1977

[30] Foreign Application Priority Data

Mar. 10, 1976 Poland ..... 187855

[51] Int. Cl.[2] ..... D01H 1/12

[52] U.S. Cl. ..... 57/58.89

[58] Field of Search ..... 57/58.89–58.95, 57/5, 34 R, 156, 160

[56] References Cited

U.S. PATENT DOCUMENTS

| | | | |
|---|---|---|---|
| 3,577,720 | 5/1971 | Zax et al. | 57/58.89 |
| 3,851,455 | 12/1974 | Jozwicki et al. | 57/58.95 |
| 3,898,787 | 8/1975 | Wehling et al. | 57/58.89 |
| 3,994,120 | 11/1976 | Radom et al. | 57/58.89 |

FOREIGN PATENT DOCUMENTS

| | | | |
|---|---|---|---|
| 244,159 | 9/1969 | U.S.S.R. | 57/58.89 |
| 244,160 | 9/1969 | U.S.S.R. | 57/58.89 |

*Primary Examiner*—Donald Watkins
*Attorney, Agent, or Firm*—Haseltine, Lake & Waters

[57] ABSTRACT

The apparatus for pneumatic manufacture of yarn from natural or synthetic fibers employs a non-rotational chamber, has an insert which contains a central yarn discharge channel, circumferential ducts to supply air as well as a fiber delivery channel at the upper portion. The insert has the guides arranged about its lower periphery, the bottom edges of these guides being screened with a shielding ring, and the air supply air ducts are located beneath the upper edges of the guides. In an alternative design, the guides are associated with the distribution ring, whose lateral inner face is in common with the insert wall and guides to thereby form air passages.

2 Claims, 4 Drawing Figures

A-A

EQUIPMENT FOR PNEUMATIC MANUFACTURE OF YARN

BACKGROUND OF THE INVENTION

This invention is directed to an apparatus for the pneumatic manufacture of yarn from natural- or synthetic fibres.

More particularly the invention is directed to an improved apparatus including structure disposed in the spinning chamber to increase yarn spinning rates.

Prior art equipment for pneumatic manufacture of yarn consisted of a cylindrical, non-rotational spinning chamber, having one end associated with a source of vacuum, and the other end being closed having a cylindrically shaped insert containing the axial channel to dispose the produced yarn. From the vacuum side, the prior art chambers have circumferential tangent air supply ducts and a delivery channel to supply fibres, the latter being located in the chamber upper part above the yarn discharge channel inlet. Resultant whirl core along the chamber center line tends to decrease spinning rates.

SUMMARY OF THE INVENTION

The apparatus of the present invention is directed to a non-rotational spinning chamber closed at one end with a cylindrically shaped insert disposed therein having a yarn discharge channel. This insert is provided with guides arranged on circumference of the insert lower part to distribute air drawn into the fibre delivery channel. Bottom edges of these guides are screened with a shielding ring and the supply air ducts being located beneath the guide upper edges.

An alternate design contemplates the distribution ring separator being attached to the guides arranged round the cylindrical insert lower part circumference. The lateral inner face of the ring is in common with the insert wall and the guides to form passages.

The main object of the present invention is to overcome the defects of the prior art.

Another object of the present invention is to provide a guide means to prevent the formation of a whirl core in the chamber center line so that the peripheral speeds at the velocity walls can be increased and the spinning rate accordingly increased.

Other objects and advantages of the present invention will be more readily understood with respect to the accompanying specification, claims and drawings.

IN THE DRAWINGS

PREFERRED EMBODIMENT

Figure 1:
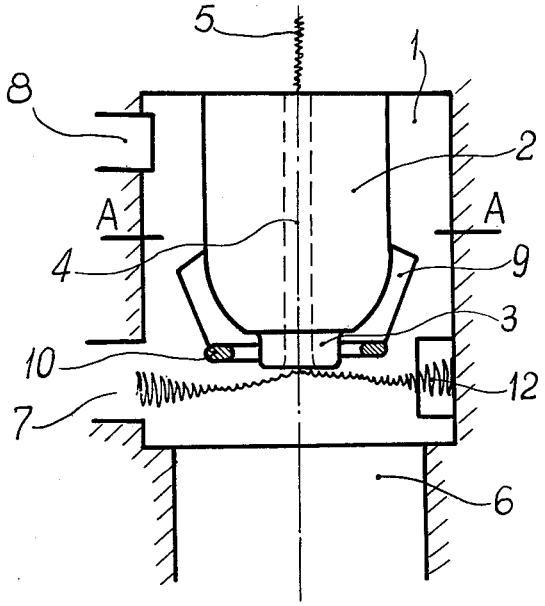
FIG. 1 illustrates the invention taken in partial cross-section along the longitudinal axis.
Figure 2:
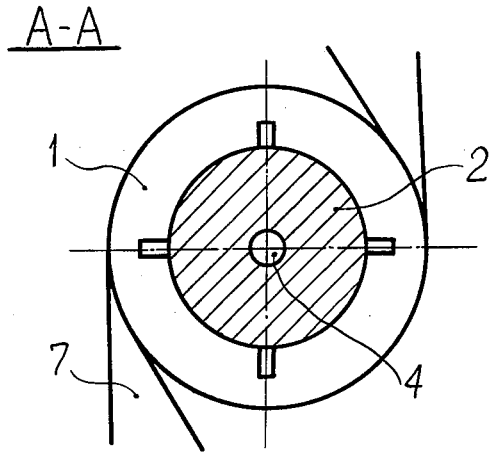
FIG. 2 is an illustration of the apparatus in cross-section taken along line A—A.

FIG. 1 shows a cylindrically shaped non-rotational chamber 1, which is closed at one end with a cylindrical insert 2 having the bow-like downwardly curved end portion terminated in cylindrical boss 3. The insert 2 is provided with a coaxial channel 4 to deliver the yarn 5. At the other end, the chamber 1 communicates via the duct 6 with the source of vacuum (not shown in the drawing). As shown in FIG. 2, the side of the vacuum source, the chamber 1 has circumferential tangent ducts 7 for supplying air. The fibre delivery channel 8 outlet is situated in the chamber wall above the channel 4 inlet. The insert 2 is provided with the guides 9 arranged from the side of the channel 4 inlet, on the insert curvature circumference. The shielding ring 10 is attached to the lower edges of the guides 9, to prevent the whirling fibres from being caught by the guides.

In operation air is drawn into the chamber 1 by the duct 6, and due to the arrangement of the passages 7 and 8 it is forced to whirl inside the chamber 1. Stream of air as drawn into the chamber 1 via the fibre delivery channel 8, gets distributed within the chamber, a part of it flowing through the guides 9 and another part along the chamber walls through supply air ducts located beneath the air division level. When the air stream passes across the guides 9, its original direction is altered with a consequent decrease in peripheral speed components and an increase in axial speed components. Thus air jets will diminish the whirl core kinetic energy, and consequently its intensity becomes reduced in response to the air volume supplied and the axial component values.

Having been introduced into the chamber 1, the fibres form the ring 12 whirling in a plane perpendicular to the chamber centre line.

For spinning, a length of yarn is introduced through the channel 4 — into the chamber interior. This length being forced to spin by the produced whirl of air, will gather the fibres from the whirling ring, and becomes twisted. Produced yarn will be discharged through the channel 4.

Figure 3:
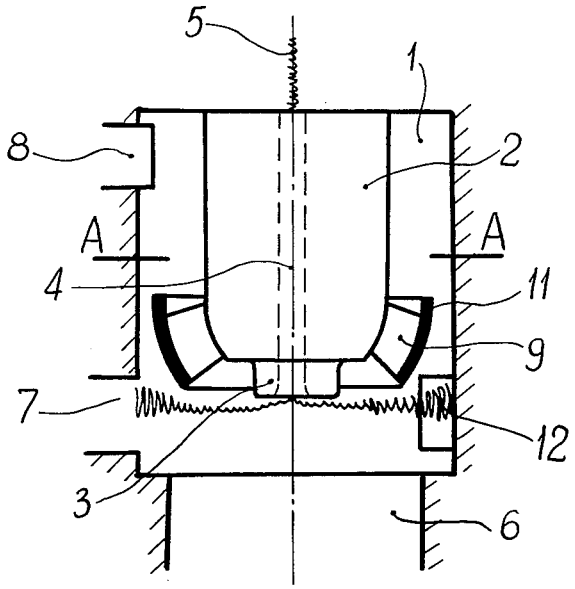
FIG. 3 is an alternate design of the present invention taken in partial cross-section along the longitudinal axis.
Figure 4:
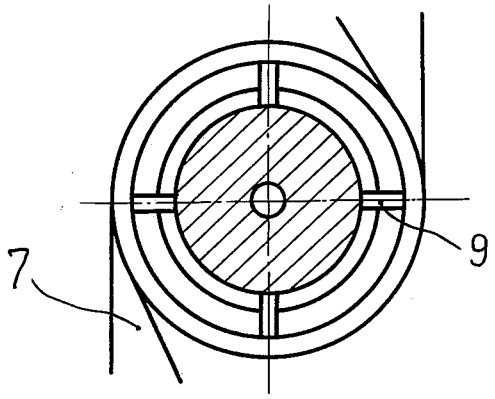
FIG. 4 is a cross-section of the apparatus illustrated in FIG. 3 taken along line A—A.

FIG. 3 and FIG. 4 illustrate the alternative embodiment employing guides 9 being arranged on the insert curvature. The distribution ring 11 together with the insert walls and guides forms the air supply ducts.

While we have illustrated a preferred embodiment of the invention many modifications may be made without departing from the spirit of the invention. It is not desired to be limited to the precise details of construction set forth but rather the intent is to avail ourselves of all changes within the scope of the appended claims.

We claim:

1. An apparatus for the pneumatic manufacture of yarn employing a non-rotational spinning chamber closed at one end having cylindrical insert means provided with a yarn discharge channel disposed therein, circumferential supply air ducts for introduction of a vacuum source into the other end of the chamber, fibre delivery channel means formed of said chamber and provided upstream of an inlet of the yarn discharge channel, said apparatus including: said cylindrical insert means being provided with guide means disposed about said insert lower periphery, whereby said guide means have lower edges screened with a shielding ring, and air supply duct means being disposed beneath upper edges of said guide means.

2. An apparatus as claimed in claim 1, wherein: said guide means on the lower periphery of said insert being provided with distribution ring means having a lateral inner face being disposed to cooperate with a wall of said insert and said guide means to thereby form air passage means.

* * * * *